US008682024B2

(12) United States Patent
Kim

(10) Patent No.: US 8,682,024 B2
(45) Date of Patent: Mar. 25, 2014

(54) APPARATUS FOR AND METHOD OF PROCESSING IMAGE DATA

(75) Inventor: Young-geol Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 932 days.

(21) Appl. No.: 12/691,823

(22) Filed: Jan. 22, 2010

(65) Prior Publication Data

US 2010/0214306 A1 Aug. 26, 2010

(30) Foreign Application Priority Data

Feb. 24, 2009 (KR) ..... 10-2009-0015432

(51) Int. Cl.
*G09G 5/36* (2006.01)

(52) U.S. Cl.
USPC ..... 382/100; 345/560

(58) Field of Classification Search
None
See application file for complete search history.

(56) References Cited

U.S. PATENT DOCUMENTS

| | | | | |
|---|---|---|---|---|
| 4,237,764 | A * | 12/1980 | Suzuki | 84/704 |
| 5,585,863 | A * | 12/1996 | Hackett et al. | 348/716 |
| 6,417,867 | B1 * | 7/2002 | Hallberg | 345/660 |
| 7,307,635 | B1 * | 12/2007 | Yang et al. | 345/560 |
| 2004/0085462 | A1 * | 5/2004 | Sasaki | 348/231.6 |
| 2005/0140796 | A1 * | 6/2005 | Okabe | 348/231.99 |
| 2008/0192146 | A1 * | 8/2008 | Yamana et al. | 348/607 |
| 2008/0291295 | A1 * | 11/2008 | Kato et al. | 348/231.99 |
| 2009/0016619 | A1 * | 1/2009 | Todoroki | 382/233 |

* cited by examiner

*Primary Examiner* — Stephen R Koziol
*Assistant Examiner* — Amandeep Saini
(74) *Attorney, Agent, or Firm* — Drinker Biddle & Reath LLP

(57) ABSTRACT

An apparatus and method of processing image data sub-samples image data by generating a data patch by dividing the image data into a plurality of blocks and sequentially accessing pixel data values in each of the blocks through a plurality of line memories. The image data is divided into the plurality of blocks, the blocks are stored in each of the line memories, and the pixel data values stored in each of the line memories are sequentially accessed, so as to generate the data patch for sub-sampling the image data.

17 Claims, 10 Drawing Sheets

FIG. 3E

| | 1 | 2 | 3 | 4 | 5 | 6 | 7 | 8 | 9 |
|---|---|---|---|---|---|---|---|---|---|
| a | | | | | | | | | |
| b | | | | | | | | | |
| c | | | c3'' | c4'' | c5'' | c6'' | c7'' | | |
| d | | | d3'' | d4'' | d5'' | d6'' | d7'' | | |
| e | | | e3'' | e4'' | e5'' | e6'' | e7'' | | |
| f | | | f3'' | f4'' | f5'' | f6'' | f7'' | | |
| g | | | g3'' | g4'' | g5'' | g6'' | g7'' | | |
| h | | | | | | | | | |
| i | | | | | | | | | |

APPARATUS FOR AND METHOD OF PROCESSING IMAGE DATA

CROSS-REFERENCE TO RELATED PATENT APPLICATION

This application claims the priority benefit of Korean Patent Application No. 10-2009-0015432, filed on Feb. 24, 2009, in the Korean Intellectual Property Office, the disclosure of which is incorporated herein in its entirety by reference.

BACKGROUND

1. Field of the Invention

The present invention relates to an apparatus for and method of processing image data, and more particularly, to an apparatus for and method of processing image data by sub-sampling image data.

2. Description of the Related Art

Generally, apparatuses for processing a digital image by using image data processing technology may use image recognizing sensors, and may be, for example, digital cameras, personal digital assistants (PDAs), phone cameras, or personal computer (PC) cameras.

An apparatus for processing a digital image may generate an image file by processing an image captured via an image pickup device by using a digital signal processor and compressing the processed image, and may store the generated image file in a memory.

Also, the apparatus may display an image from an image file, captured via the image pickup device or stored in a storage medium, on a display device such as a liquid crystal display (LCD).

Regarding such an apparatus, competition between manufacturers has led to developments in high sensitivity photographing, since competition in developing high pixel photographing is saturated. Here, noise due to heat generated by a charge coupled device (CCD) or by a complementary metal oxide semiconductor (CMOS) or low frequency noise due to interference in an electronic circuit is amplified while amplifying a signal during high sensitivity photographing. Accordingly, it is required to effectively remove noise that may occur on an output image.

Conventionally, a low pass filter (LPF) is widely used for noise reduction (NR). Since a noise component is typically generated as a high frequency component on a plane of an image, a LPF blocks the high frequency component so as to remove the noise component.

However, a LPF removes an edge component of an image, and thus image sharpness decreases. Accordingly, technology relating to removing noise while maintaining an edge component is required.

Consequently, technology relating to removing noise by sampling an image and processing the image by using software is introduced.

However, processing speeds of such conventional technology using software are slow. In other words, all operations are performed in a central processing unit (CPU), and thus the processing speed depends on the CPU. Since a CPU not only processes an image but also performs other operations simultaneously, the processing speed is limited. Also, image data before being processed in software is stored in a storage device, such as a SecureDigital/CompactFlash/SmartMedia (SD/CF/SM) card, and thus the speed at which image data is read is greatly limited.

Specifically, technology related to removing noise randomly accesses a storage device storing image data, while reading a data value for sub-sampling so as to process an image. In this case, a memory load is discontinuously generated, and thus the apparatus may be overloaded. Accordingly, the processing speed is decreased.

SUMMARY

Embodiments of the present invention include an apparatus and method of processing image data by sub-sampling the image data. The apparatus and method quickly and easily generate a data patch for sub-sampling the image data by dividing the image data into a plurality of blocks and sequentially access pixel data values in each block through a plurality of line memories.

According to an aspect of the present invention, an apparatus for processing image data includes a plurality of line memories and a divider having an image data input and a plurality of block outputs. The divider is configured to divide the image data into a plurality of blocks. The apparatus also includes a line memory controller communicatively coupled with the divider and the plurality of lines memories. The line memory controller is configured to store the plurality of blocks from the divider into respective line memories. The apparatus further includes a data patch generator communicatively coupled with the plurality of line memories and having a data patch output. The data patch generator is configured to generate a data patch for sub-sampling of the image data by sequentially accessing pixel data values stored in each of the plurality of line memories.

The plurality of blocks may correspond to rows of a matrix of the image data.

The data patch generator may include a plurality of delay registers that each store the pixel data values stored in a respective one of the plurality of line memories by shifting the pixel data values stored in the respective line memory by one bit for each reference clock. The data patch generator may also include a pixel data extractor that extracts pixel data values located in predetermined addresses from each of the plurality of delay registers.

The line memory controller may select a number of blocks corresponding to the number of columns of a matrix to be used as the data patch, from among the plurality of blocks, and store the selected blocks in the respective line memories, and the data patch generator may extract pixel data values in a number of rows of the matrix of the data patch from each of the plurality of line memories, and generate a matrix to be used as a data patch, wherein the pixel data values extracted from the same line memory are in the same row.

The line memory controller may select blocks that are spaced apart from each other by a uniform interval, from among the plurality of blocks, and the data patch generator may extract a plurality of pixel data values that are spaced apart from each other by a uniform interval, from among the pixel data values stored in each of the plurality of line memories.

The plurality of line memories may include a number of line memories equal to or greater than the number of columns of a matrix to be used as the data patch.

The line memory controller may determine whether there is a block already stored in the plurality of line memories from among the selected blocks, and store remaining blocks excluding the block stored in the plurality of line memories.

The divider, the line memory controller, and the data patch generator may include at least one of an application-specific integrated circuit (ASIC), a substrate, or a field-programmable gate array (FPGA).

According to another aspect of the present invention, a method of processing image data of an apparatus for processing image data including a plurality of line memories may include dividing the image data into a plurality of blocks, storing each of the plurality of blocks into a respective one of the plurality of line memories, and generating a data patch for sub-sampling of the image data by sequentially accessing pixel data values stored in each of the plurality of line memories.

In the dividing of the image data, the plurality of blocks may correspond to rows of a matrix of the image data.

The generating of the data patch may include storing the pixel data values stored in each of the plurality of line memories in respective one of a plurality of delay registers by shifting the pixel data values by one bit for each reference clock, and extracting pixel data values located in predetermined addresses from each of the plurality of delay registers.

The storing of the generated blocks may include selecting a number of blocks corresponding to the number of columns in a matrix to be used as the data patch and storing each of the selected blocks in a respective one of the plurality of line memories, and the generating of the data patch may include extracting a number of pixel data values corresponding to the number of rows in the matrix to be used as the data patch from each of the plurality of line memories and generating a data patch in a matrix form, wherein the pixel data values extracted from the same line memory are in the same row.

The storing of the plurality of blocks may further include selecting blocks that are spaced apart from each other by a uniform interval, from among the plurality of blocks, and the generating of the data patch may further include extracting a plurality of pixel data values that are spaced apart form each other by a uniform interval, from among the pixel data values stored in each of the plurality of line memories.

The storing of the blocks may include determining whether there is a block already stored in the plurality of line memories from among the selected blocks, and storing the remaining blocks excluding the block stored in the plurality of line memories.

According to another aspect of the present invention, a computer-readable storage medium may have stored thereon a program executable by a processor for performing a method of processing image data as described herein.

BRIEF DESCRIPTION OF THE DRAWINGS

The above and other features and advantages of the present invention will become more apparent by describing in detail exemplary embodiments thereof with reference to the attached drawings in which:

FIGS. 3A through 3E are diagrams for describing an exemplary process of performing filtering for removing noise from image data;

DETAILED DESCRIPTION

Hereinafter, the present invention will be described more fully with reference to the accompanying drawings, in which exemplary embodiments of the invention are shown. While describing the present invention, detailed descriptions about related well-known functions or configurations that may diminish the clarity of the points of the present invention are omitted.

When a part "includes" an element, the part may further include another element rather than excluding other elements, unless described otherwise.

The exemplary embodiments of the present invention will now be described with reference to enclosed drawings.

Figure 1:
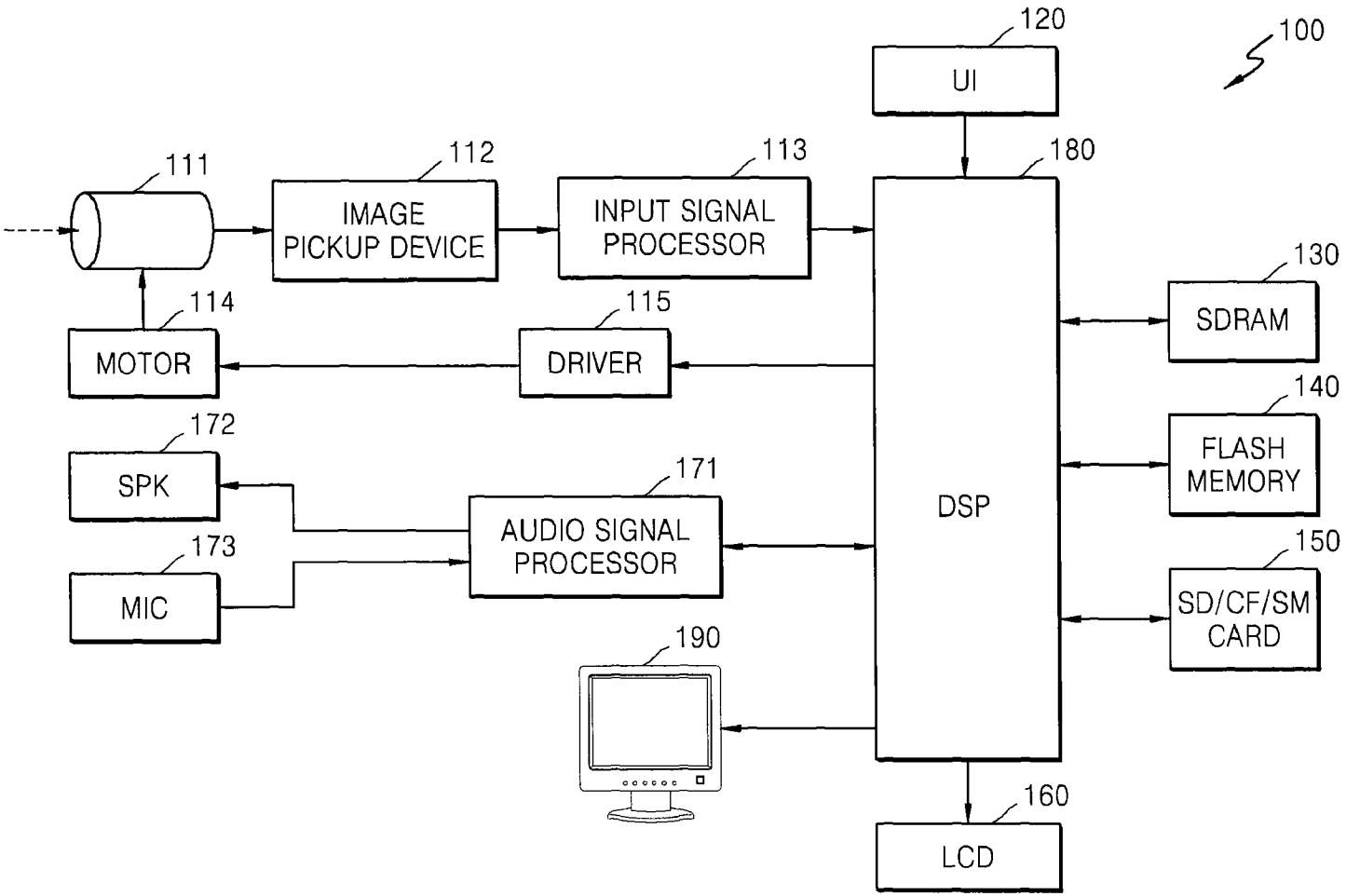
FIG. 1 is a block diagram of a digital camera that is an embodiment of an apparatus for processing a digital image, on which an apparatus for and method of processing image data according to the present invention may be applied.

FIG. 1 is a block diagram of a digital camera 100 that is an embodiment of an apparatus for processing a digital image, on which an apparatus for and method of processing image data according to the present invention may be applied.

Referring to FIG. 1, the digital camera 100 includes the following: an optical unit 111 that receives an optical signal corresponding to a subject; an image pickup device 112 that converts the optical signal received by the optical unit 111 into an electric signal; and an input signal processor 113 that performs signal processing on the electric signal provided by the image pickup device 112, such as noise reduction processing or conversion processing into a digital signal. The digital camera 100 further includes a motor 114 that drives the optical unit 111 and a driver 115 that controls operations of the motor 114. Also, the digital camera 100 further includes the following: a user interface 120 that receives a manipulation signal from a user; a synchronous dynamic random access memory (SDRAM) 130 that temporarily stores input image data, data for an operation process, and a process result; a flash memory 140 that stores an algorithm, setting data, or the like required to operate the digital camera 100; and a SecureDigital/CompactFlash/SmartMedia (SD/CF/SM) card 150 that is a recording device for storing an image file. Also, a liquid display device (LCD) 160 is installed in the digital camera 100, as a display device. The digital camera 100 may further include the following: an audio signal processor 171 that converts sound from a sound source into a digital signal, converts a digital signal corresponding to the sound source into an analog signal, and generates an audio file; a speaker 172 that outputs sound; and a microphone 173 that receives sound. The digital camera 100 further includes a digital signal processor (DSP) 180 that controls operations of the digital camera 100.

Each element of the digital camera 100 will now be described in detail.

The optical unit 111 may include lenses for focusing the optical signal, an iris for adjusting the amount of the optical signal received (light intensity), and a shutter for controlling input of the optical signal. The lenses may include a zoom lens unit that narrows or widens a view angle according to a focal length, and a focus lens unit that focuses the optical signal corresponding to a subject. The zoom lens unit and the focus lens unit may be each formed in one or more lenses. The shutter may be mechanical, wherein a cover moves up and down. Alternatively, the image pickup device 112 may operate as a shutter by supplying electric signals to the image pickup device 112.

The motor 114, which drives the optical unit 111, may position the lens units, open and close the iris, and operate the shutter, so as to perform auto focus, auto exposure adjustment, iris adjustment, and zoom or focus change.

The motor 114 is controlled by the driver 115. The driver 115 controls operations of the motor 114 according to a control signal input from the DSP 180.

The image pickup device 112 receives the optical signal received by the optical unit 111 and forms an image of the subject. The image pickup device 112 may be a complementary metal oxide semiconductor (CMOS) sensor array or a charge coupled device (CCD) sensor array.

The input signal processor 113 may include an analog/digital (A/D) converter (not shown) that converts the electric signal, i.e. an analog signal, supplied by the image pickup device 112 into a digital signal. Also, the input signal processor 113 may include a circuit (not shown) that adjusts a gain or standardizes a waveform of the electric signal provided by the image pickup device 112.

The UI 120 may include a member for a user to manipulate the digital camera 100 or for selecting various settings for photographing. For example, the UI 120 may be realized as a button, a key, a touch panel, a touch screen, or a dial, and may receive a user control signal, such as a power on/off signal, a photographing start/stop signal, a reproduction start/stop/search signal, an optical system driving signal, a mode converting signal, a menu manipulating signal, or a selection manipulating signal.

The SDRAM 130 may temporarily store raw data (such as RGB data) of an image provided by the input signal processor 113, wherein a predetermined signal process is performed on the raw data according to an operation of the DSP 180, or may transmit the raw data to another element. The SDRAM 130 may temporarily store algorithm data according to an algorithm stored in the flash memory 140 by converting the algorithm data into executable data. The DSP 180 processes the executable data stored in the SDRAM 130 so as to perform operations according to the algorithm. Moreover, the SDRAM 130 may temporarily store image data obtained by decompressing an image file stored in the flash memory 140. The temporarily stored image data may be transmitted to the LCD 160, wherein a predetermined image corresponding to the image data is then displayed. The SDRAM 130 may be one of various volatile memories, which may temporarily store data while power is being supplied, or a semiconductor device, in which a plurality of memory devices are integrated.

The flash memory 140 may store an operating system required to operate the digital camera, an application program, or data for executing an algorithm of a method of processing image data. Examples of the flash memory 140 include various nonvolatile memories, such as a read only memory (ROM).

The SD/CF/SM card 150 may record an image file generated by compressing the image data provided by the input signal processor 113. Examples of the SD/CF/SM card 150 include a nonvolatile memory, hard disc drive (HDD), an optical disc, a magnetic optical disc, and a holographic memory.

The LCD 160 may display an image corresponding to image data provided by the input signal processor 113 in real time, or may display an image corresponding to image data restored from an image file stored in the SD/CF/SM card 150. The display device used in the current embodiment is the LCD 160, but the display device is not limited thereto, and an organic light emitting display device or an electrophoresis display device may also be used.

The audio signal processor 171 converts a digital signal corresponding to a sound source, provided by the DSP 180, into a sound, and amplifies the sound, and transmits the sound to the speaker 172 so that the speaker 172 outputs the sound. Alternatively, the audio signal processor 171 may receive a sound from the microphone 173, and may convert and compress the sound into a digital signal and may then generate an audio file. The generated audio file is transmitted to the DSP 180 for the DSP 180 to operate on the audio file.

The DSP 180 may reduce noise in the received image data, and may perform image signal processing, such as gamma correction color filter array interpolation, color matrix, color correction, or color enhancement. The DSP 180 may generate an image file by compressing image data generated by performing image signal processing, or may restore image data from an image file. A method of compressing an image may be reversible or irreversible. For example, an image may be compressed into a Joint Photographic Experts Group (JPEG) format or a JPEG 2000 format. Also, the DSP 180 may functionally perform an indistinctness process, a color process, a blur process, an edge emphasis process, an image analysis process, an image recognition process, or an image effect process. A scene recognition process may be performed as an image recognition process. Also, the DSP 180 may perform a display image signal process so as to display an image on the LCD 160. For example, the DSP 180 may perform a luminance level adjustment, a color compensation, a contrast adjustment, an outline emphasis adjustment, a screen division process, a character image generation process, or an image synthesis process. The DSP 180 may be connected to an external monitor 190 and may perform predetermined image signal processing so that an image is displayed on the external monitor 190. Here, the DSP 180 may transmit processed image data to the external monitor 190 so that an image corresponding to the processed image data is displayed on the external monitor 190.

The DSP 180 may process an image signal as described above, and may control each element of the digital camera 100 according to a result of processing the image signal. Alternatively, the DSP 180 may control each element according to a control signal input by a user via the UI 120. An algorithm for processing an image signal is stored in the flash memory 140, and the algorithm may be converted to executable data and stored in the SDRAM 130 for the DSP 180 to perform an operation corresponding to the algorithm.

Figure 2:
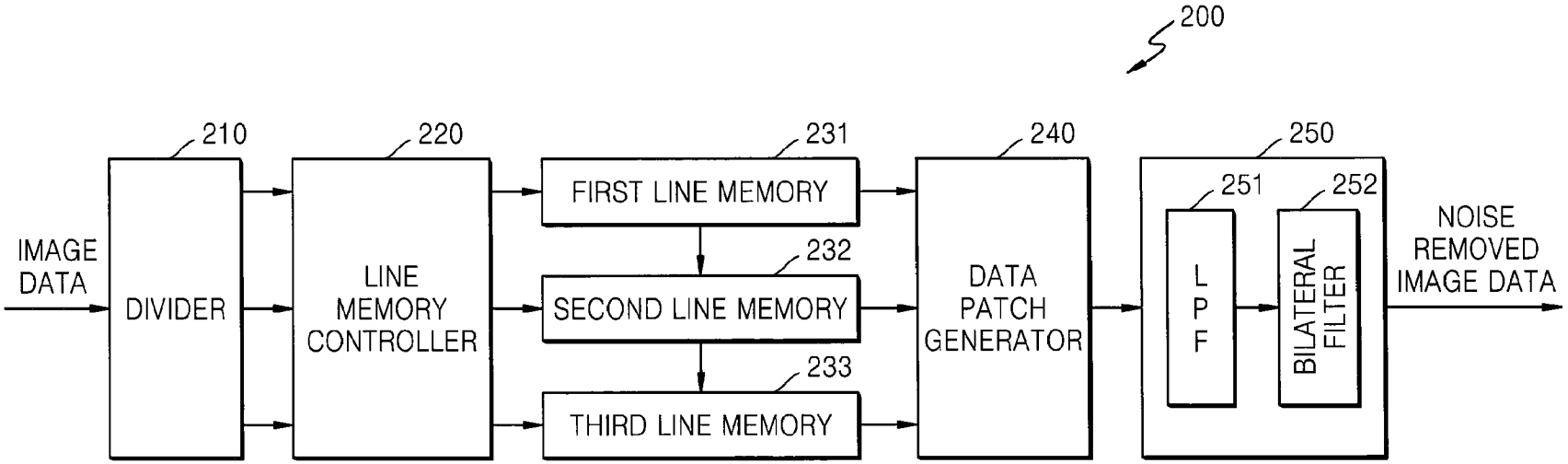
FIG. 2 is a block diagram of an apparatus for processing image data of an apparatus for processing a digital image, according to an embodiment of the present invention.

The DSP 180 of the digital camera 100 may include an apparatus for processing image data illustrated in FIG. 2.

FIG. 2 is a block diagram of an apparatus 200 for processing image data of an apparatus for processing a digital image, according to an embodiment of the present invention. The apparatus 200 according to the current embodiment of the present invention may be installed inside the DSP 180 of the digital camera 100 of FIG. 1.

Referring to FIG. 2, the apparatus 200 includes a divider 210, a line memory controller 220, a plurality of line memories 231 through 233, a data patch generator 240, and a noise removal filter 250.

The divider 210 divides image data into a plurality of blocks. Generally, image data is formed by arranging pixel data values of the image data into a two-dimensional matrix. While dividing the image data, each row of a matrix of the image data may correspond to each block, respectively. Here, the blocks have a length corresponding to a (pixel) width of the image data and the number of blocks generated corresponds to the number of rows in the matrix of the image data.

The line memory controller 220 may store each of the blocks generated by the divider 210 in one of the line memories 231 through 233, sequentially. Unlike other storage devices, such as a main memory, that are connected to an external apparatus via a bus, the line memories 231 through 233 are installed in the apparatus 200 as an internal circuit. Accordingly, the capacity of the line memories 231 through 233 is limited compared to the capacity of the main memory, but data stored in the line memories 231 through 233 are more easily and quickly accessed. In the current embodiment, the line memories 231 through 233 may have capacity equal to or greater than a length of the generated block.

While there are three line memories illustrated in FIG. 2 and described with reference to FIG. 2, in various embodiments there may be any number of line memories. For example, there may be as many line memories as there are blocks generated by the divider 210. Generally, the number of line memories is less than the number of generated blocks, and thus a number of the generated blocks equal to the number of the line memories 231 through 233 are selected and stored in the line memories 231 through 233 sequentially according to a predetermined sub-sampling rule. The line memory controller 220 may determine whether each of the line memories 231 through 233 already store a block, and may store remaining blocks excluding the previously stored blocks in the line memories 231 through 233. In such a way, a memory load and the overall performance time of the apparatus 200 may be reduced.

Also, the data patch generator 240 generates a data patch for sub-sampling by sequentially accessing pixel data values stored in each of the line memories 231 through 233. Generally, the data patch for sub-sampling may be a 3×3 matrix or 5×5 matrix.

In order to sequentially access the pixel data values stored in each of the line memories 231 through 233, the data patch generator 240 may include a plurality of delay registers (not shown) and a pixel data extractor (not shown).

The delay registers store the pixel data values stored in each of the line memories 231 through 233 by shifting the pixel data values by one bit for each reference clock. A reference clock may be a single cycle of a periodic clock signal.

The pixel data extractor extracts the pixel data values from predetermined addresses in the delay registers according to the sub-sampling rule.

The line memory controller 220 selects a number of blocks equal to the number of columns in a matrix of a data patch to be generated, among the blocks generated by the divider 210, and stores the selected blocks one by one in each of the plurality of line memories 231 through 233. The data patch generator 240 may extract pixel data values for each row and column of the data patch by extracting a number of the pixel data values equal to the number of rows in the matrix of the data patch to be generated from each of the line memories 231 through 233. Here, each row of the matrix of the data patch is formed of the pixel data values extracted from each of the line memories 231 through 233, respectively. In other words, the data patch is a matrix, in which the pixel data values extracted from the same line memory are in the same row.

Here, the number of rows or the number of columns of the matrix of the data patch denotes a size of a kernel filter.

For example, when a 3×3 data patch is used, i.e. when a 3×3 data patch and a 3×3 kernel filter is used, the line memory controller 220 selects three blocks from among the plurality of blocks generated by the divider 210, and stores the selected 3 blocks respectively in the line memories 231 through 233. In the apparatus 200, since one block is stored in one line memory, the apparatus 200 may include at least three line memories.

A 3×3 data patch is formed by using pixel data values from a matrix of image data, wherein the pixel data values are disposed in the 3×3 data patch by horizontally and vertically shifting the matrix of image data, according to the sub-sampling rule used in the current embodiment, and in addition, the line memory controller 220 selects a first line, a third line, and a fifth line, and stores the first, third, and fifth lines into the first line memory 231, the second line memory 232, and the third line memory 233, respectively.

First through third delay registers of the data patch generator 240 store, respectively, the pixel data values stored in the first through third line memories 231 through 233 by shifting the pixel data values by one bit for each reference clock.

When the first through third delay registers are full, the pixel data extractor of the data patch generator 240 extracts pixel data values stored in first, third, and fifth addresses of each delay register, and generates a matrix to be used as a data patch, in which the pixel data values extracted from the same delay register are in the same row.

In other words, the data patch generator 240 generates a 3×3 data patch having a row formed of three pixel data values extracted from first, third, and fifth addresses of the first delay register, another row formed of three pixel data values extracted from first, third, and fifth addresses of the second delay register, and another row formed of three pixel values extracted from first, third, and fifth addresses of the third register.

The noise removal filter 250 outputs noise-removed image data by filtering the image data based on the data patch generated by the data patch generator 240. The noise removal filter 250 may include a low pass filter (LPF) 251 and a bilateral filter 252.

FIGS. 3A through 3E are diagrams for describing an exemplary process of performing filtering for removing noise from image data, wherein the process is performed in the noise removal filter 250 of the apparatus 200.

Figure 3A:
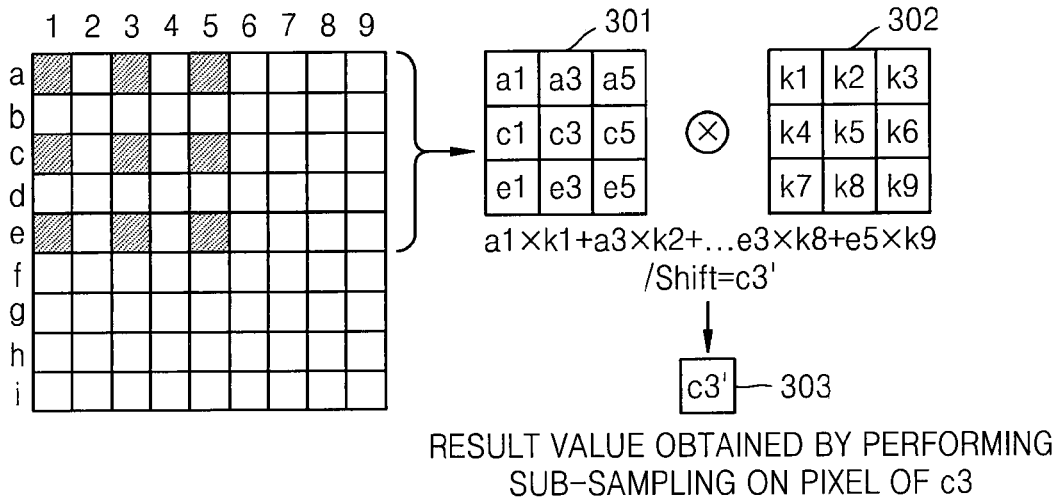
Figure 3B:
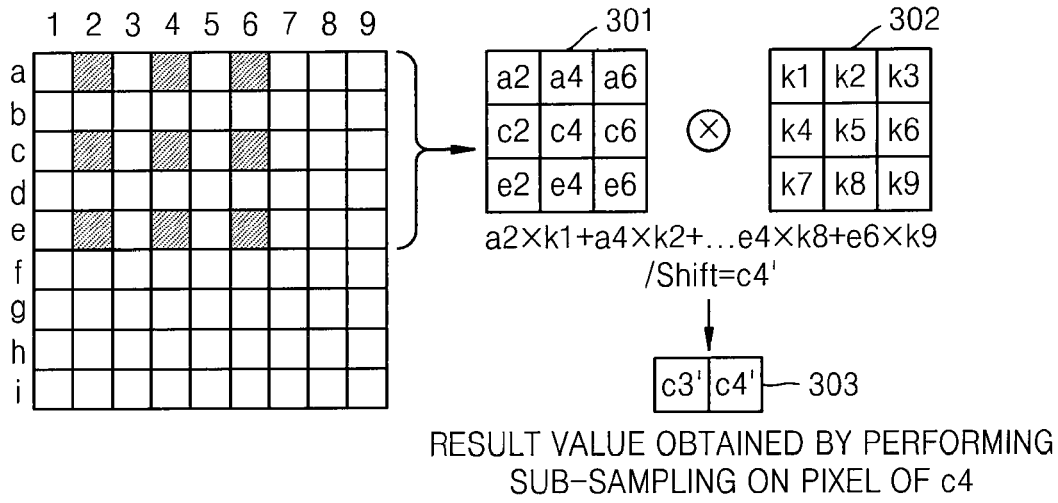
Figure 3C:
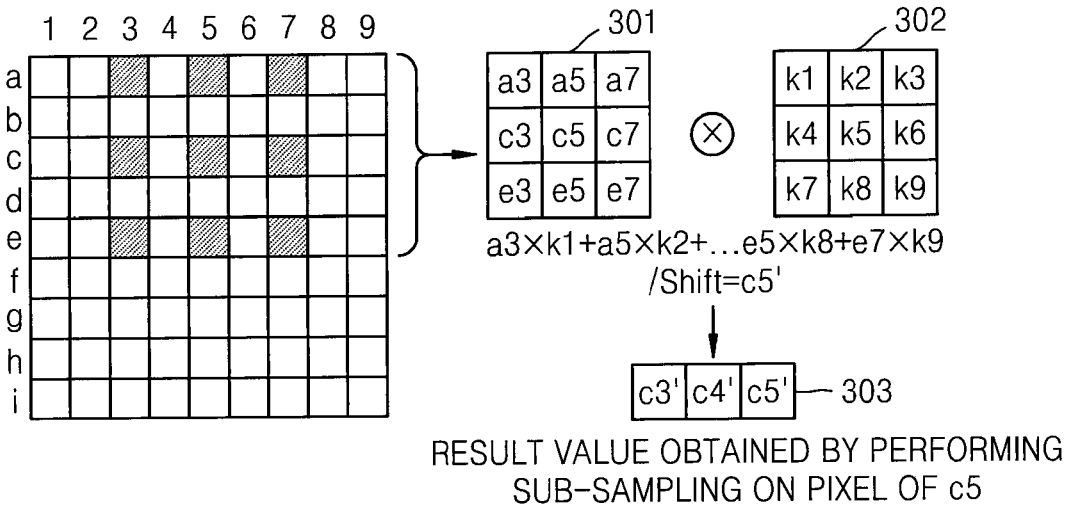

Referring to FIG. 3A, the LPF 251 generates a weight filtering result value 303 based on a 3×3 data patch 301 generated by the data patch generator 240 and a matrix 302 formed of weight filtering coefficients. Then as shown in FIGS. 3B and 3C, such a process of generating a weight filtering result value 303 is repeated for each pixel of image data.

As such, the LPF 251 generates image data that is sub-sampled with the weight filtering result values 303 of each pixel of the image data.

Figure 3D:
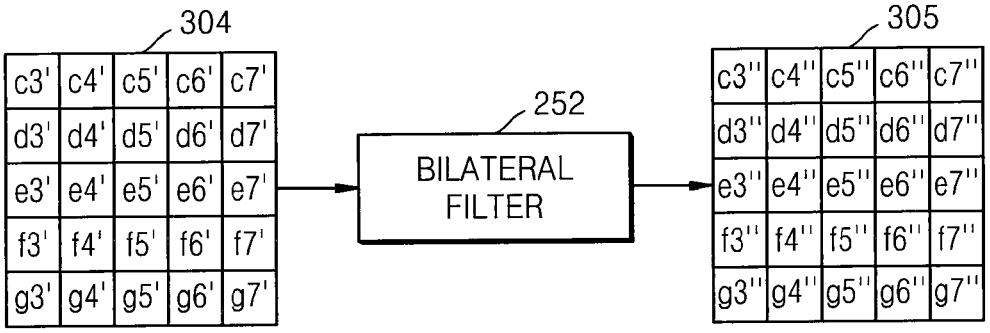

Referring to FIGS. 3D and 3E, a bilateral filter 252 compares pixel data values of sub-sampled image data 304 with predetermined threshold values so as to perform noise filtering, and thus generates noise removed image data 305.

Moreover, a data patch generated by the data patch generator 240 is not only used to remove noise from image data as described in the current embodiment, but may also be used to perform data size adjustment, automatic exposure, or automatic white-balance function.

Here, the apparatus 200 is a module including a plurality of integral circuits. In detail, each element of the apparatus 200 may be formed in an application-specific integrated circuit (ASIC), so as to quickly perform sub-sampling on image data. However, the apparatus 200 is not limited to an ASIC, and may be realized as a circuit board embedded in the digital camera 100 or hardware such as a field-programmable gate array (FPGA). Alternatively, the apparatus 200 may be formed using a combination of software and hardware, wherein examples of the software include a task, a class, a sub-routine, a process, an object, an execution thread, and a program that are performed in a predetermined area of a memory. Each element of the apparatus 200 may be included in a computer readable recording medium, or distributed in a plurality of computers.

Figure 4:
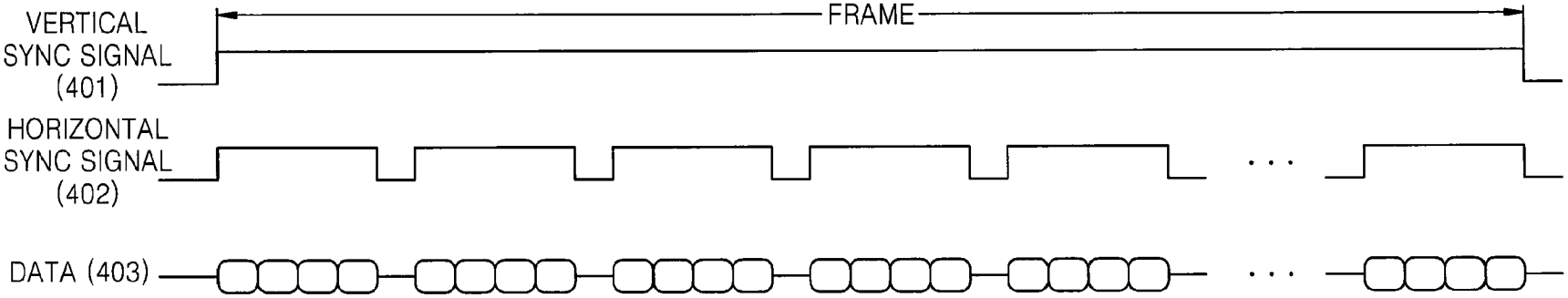
FIG. 4 is a diagram for describing an exemplary process of processing an image signal using an application-specific integrated circuit (ASIC)

FIG. 4 is a diagram for describing an exemplary process of processing an image signal such as a video signal using an ASIC. Referring to FIG. 4, the video signal includes a vertical sync signal (VD or v-sync) 401, a horizontal sync signal (HD or h-sync) 402, and data 403. The vertical sync signal 401 is a signal for adjusting sync according to each frame, the horizontal sync signal 402 is a signal for adjusting sync according to a unit block of the frame, and the data 403 includes pixel data values in the frame.

Here, a frame is a unit of a video signal, and denotes image data in a 2D matrix formed of pixel data values in the current embodiment of the present invention.

Generally, when an image is processed in using an ASIC, a random access method, wherein image data is read by transmitting a data request signal (REQ signal) including an address and size of the image data to a memory or to a sensor in which the image data is stored, is performed. However, when the image data is read and processed by using the random access method, performance of the ASIC is highly limited.

For example, when an ASIC transmits an REQ signal via a bus connected to a memory for sub-sampling of image data, processes of transmitting an REQ signal for all pixel data values of the image data, reading the image data from the memory, and transmitting an acknowledgement (ACK) signal in response to the REQ signal are repeated each time. Accordingly, image processing time is mostly spent on reading the image data from the memory.

Also, until the image data is read from the memory, other elements of the ASIC are not operated because there is no data to be processed, therefore the efficiency of the ASIC is remarkably low.

Moreover, when an x by x filter is used while processing an image, $x^2$ pixel data values need to be read from a main memory so as to generate a data patch for one pixel. However, when the random access method is used, the pixel data values that are already read cannot be used for a following pixel, and thus image processing efficiency decreases.

The apparatus 200 according to the current embodiment includes a number of line memories corresponding to the value (x) of the filter, generates a data patch by using the line memories, and reuses pixel data values stored in the line memories while generating a data patch for a following pixel. Accordingly, efficiency of the apparatus 200 is increased.

Figure 5:
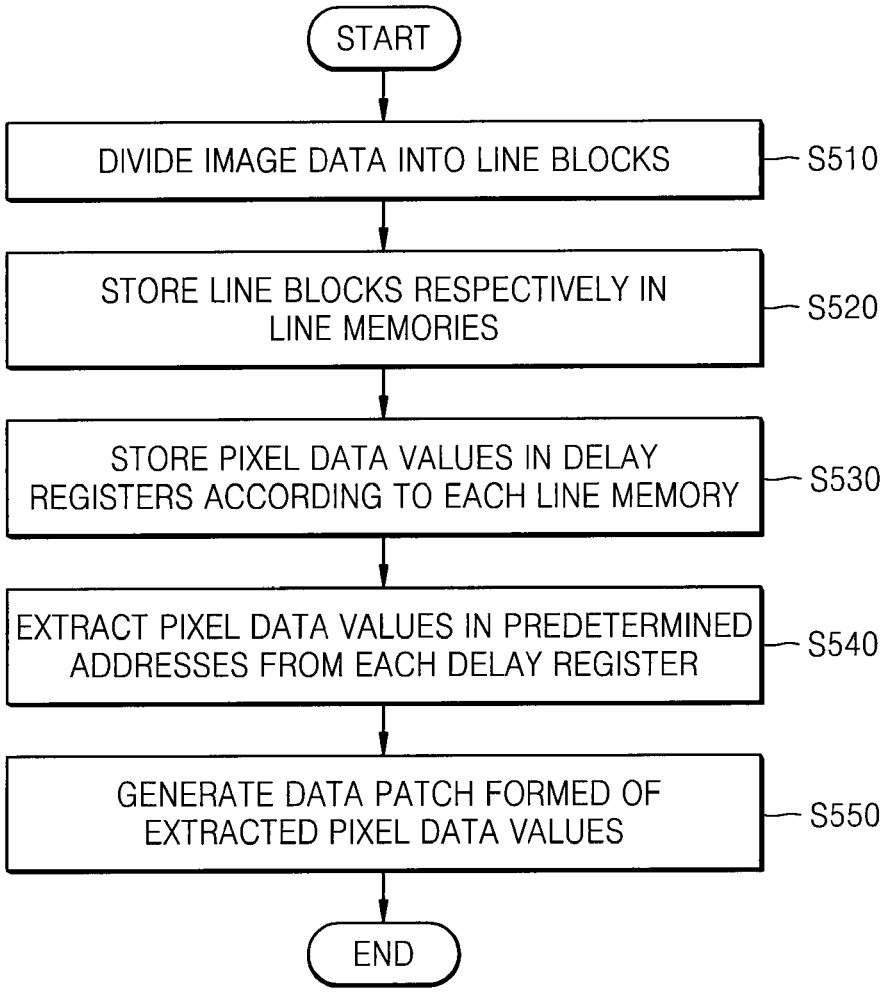
FIG. 5 is a flowchart illustrating a method of processing image data performed in an apparatus for processing a digital image, according to an embodiment of the present invention.

FIG. 5 is a flowchart illustrating a method of processing image data performed in an apparatus for processing a digital image, according to an embodiment of the present invention, and FIGS. 6A through 6F are diagrams for describing a data processing process performed in the method of FIG. 5. The method according to the current embodiment may be realized in the apparatus 200 illustrated in FIG. 2. Accordingly, the method may be stored in a storage medium of the apparatus 200 or may include a program or an algorithm realized in a semiconductor chip, such as firmware.

Also, the method may be performed by the apparatus 200. Accordingly, details about the method that are identical to the apparatus 200 are not repeated.

Figure 6A:
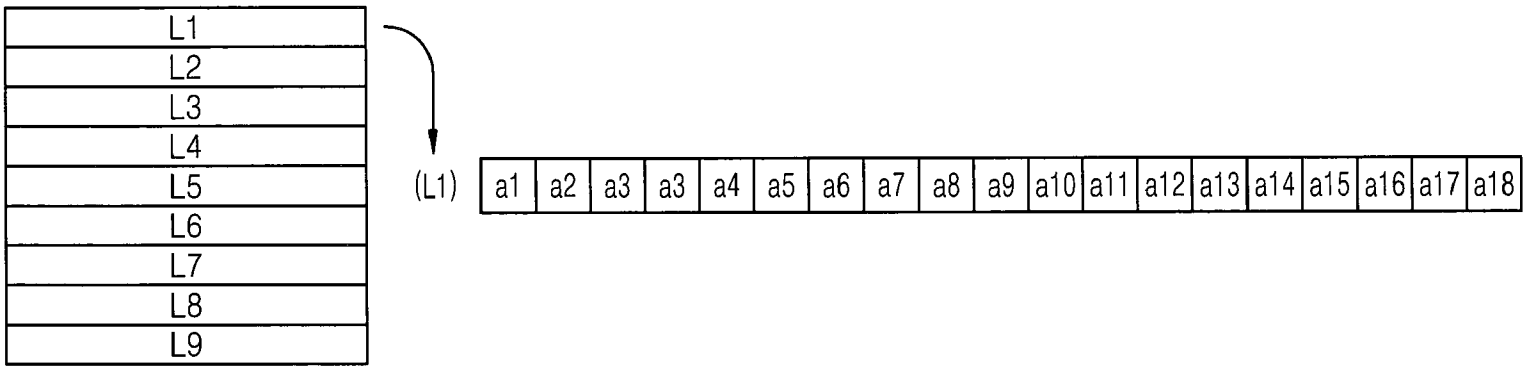
FIGS. 6A through 6F are diagrams for describing a data processing process performed in the method of processing image data performed in an apparatus for processing a digital image of FIG. 5, according to an embodiment of the present invention.

As illustrated in FIG. 6A, the apparatus 200 divides image data in a main memory into line blocks L1 through L9, in operation S510. Pixel data values of each of the generated line blocks L1 through L9 are stored in the main memory sequentially.

The apparatus 200 according to the current embodiment reads first, third, and fifth blocks L1, L3, and L5 from the main memory according to a predetermined sub-sampling rule, and stores the first, third, and fifth blocks L1, L3, and L5 respectively in each of line memories A, B, and C, in operation S520.

Figure 6B:
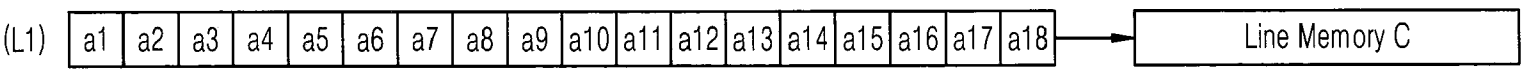
Figure 6C:
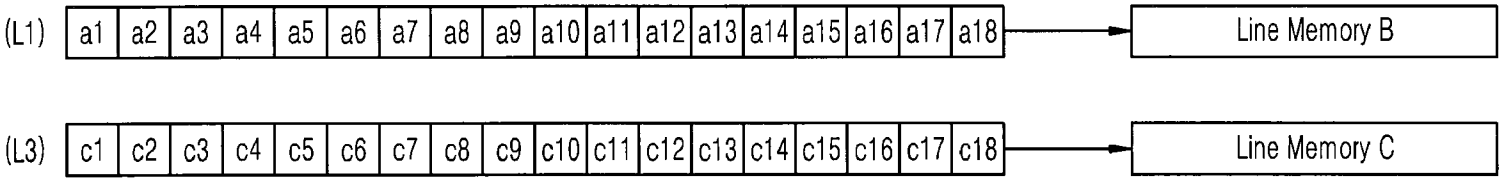

In detail, as illustrated in FIG. 6B, the first line block L1 is read from the main memory and then stored in the line memory C. Then, as illustrated in FIG. 6C, the first line block L1 stored in the line memory C is transferred to the line memory B, and the third line block L3 is read from the main memory and then stored in the line memory C.

Figure 6D:
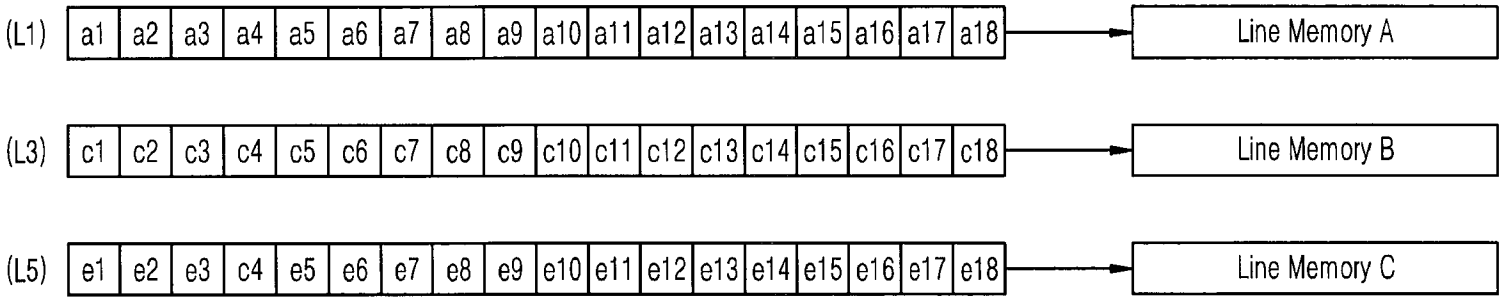

Next, as illustrated in FIG. 6D, the first and third line blocks L1 and L3 stored in the line memories B and C, respectively, are transferred to the line memories A and B, respectively, and the fifth line block L5 is read from the main memory and then stored in the line memory C.

Figure 6E:
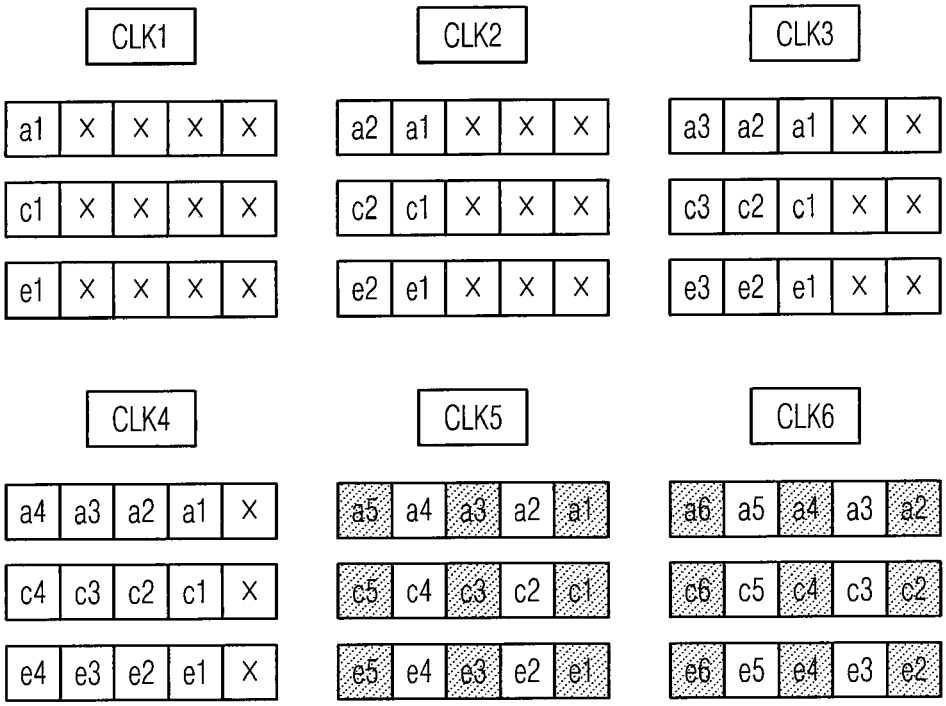

As illustrated in FIG. 6E, the apparatus 200 shifts pixel data values of the first, third, and fifth line blocks L1, L3, and L5 stored in the line memories A, B, and C, respectively, by one bit for each reference clock, and stores the shifted pixel data values in delay registers according to each of the first, third, and fifth line block L1, L3, and L5, in operation S530. Then, pixel data values located in addresses predetermined according to the sub-sampling rule, for example, in first, third, and fifth addresses of the delay registers, are extracted from each of the delay registers, in operation S540.

Figure 6F:
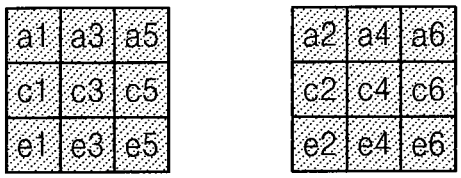

In operation S550, the apparatus 200 generates a matrix for a data patch that is to be formed of the extracted pixel data values. As illustrated in FIG. 6F, the pixel data values extracted from the same delay register are in the same row of a 3×3 matrix to be used as a data patch.

Once the data patch based on the first, third, and fifth line blocks L1, L3, and L5 is generated, operations S520 through S550 are repeated so as to generate a data patch based on the third, fifth, and seventh line blocks L3, L5, and L7. Here, since only the seventh line block L7 is needed to be read instead of the first line block L1 in operation S520, memory load and overall performance time of the method are reduced.

Then, a data patch may be generated based on the fifth, seventh, and ninth line blocks L5, L7, and L9, a data patch may be generated based on the second, fourth, and sixth line blocks L2, L4, and L6, and then a data patch may be generated based on the fourth, sixth, and eighth line blocks L4, L6, and L8.

The apparatus 200 according to the current embodiment performs filtering so as to remove noise from image data, based on data patches formed of pixel data values of the image data, and stores the filtered image data in a main memory.

According to the present invention, an apparatus for processing a digital image divides image data into a plurality of blocks, stores the blocks in a plurality of line memories, sequentially, and sequentially reads pixel data values stored in each of the line memories. Accordingly, a data patch for sub-sampling can be quickly and easily generated. The generated data patch is not only used to remove noise from the image data, but also used to perform an image process, such as data size adjustment, automatic exposure, or automatic white-balance process.

In general, the apparatus may be implemented using any general purpose computing device or devices. Any of the computing devices may comprise a processor, a memory for storing program data and executing the program data, a permanent storage such as a disk drive, a communications port for handling communications with external devices, and user interface devices, including a display, keyboard, mouse, etc. When software modules are involved, these software modules may be stored as program instructions executable on the processor on a computer-readable storage medium, where the program instructions stored on this medium can be read by the computing device, stored in the memory, and executed by the processor. Examples of the storage medium include magnetic storage media (e.g., floppy disks, hard disks, or magnetic tape), optical recording media (e.g., CD-ROMs or digital versatile disks (DVDs)), and electronic storage media (e.g., integrated circuits (IC's), ROM, RAM, EEPROM, or flash memory). The storage medium may also be distributed over network-coupled computing devices so that the program instructions are stored and executed in a distributed fashion.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like. The word mechanism is used broadly and is not limited to mechanical or physical embodiments, but can include software routines in conjunction with processors, etc.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical".

As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

It will be recognized that the terms "comprising," "including," and "having," as used herein, are specifically intended to be read as open-ended terms of art. The use of the terms "a" and "and" and "the" and similar referents in the context of describing the invention (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein can be performed in any suitable order unless otherwise indicated herein or otherwise clearly contradicted by context.

What is claimed is:

1. An apparatus for processing image data, the apparatus comprising:

a plurality of line memories installed in the apparatus as an internal circuit;

a divider having an image data input and a plurality of block outputs, the divider configured to divide the image data input into a plurality of blocks, wherein each of the plurality of blocks corresponds to a respective row of a matrix of the image data, and has a length corresponding to a width of the image data;

a line memory controller communicatively coupled with the divider and the plurality of line memories, the line memory controller configured to store each of the plurality of blocks from the divider into a respective line memory; and a data patch generator communicatively coupled with the plurality of line memories and having a data patch output, the data patch generator configured to generate a data patch for sub-sampling of the image data by sequentially accessing pixel data values stored in each of the plurality of line memories.

2. The apparatus of claim 1, wherein the data patch generator comprises:

a plurality of delay registers that each store the pixel data values stored in a respective one of the plurality of line memories by shifting the pixel data values stored in the respective line memory by one bit for each reference clock; and a pixel data extractor that extracts pixel data values located in predetermined addresses from each of the plurality of delay registers.

3. The apparatus of claim 1, wherein:

the line memory controller selects a number of blocks corresponding to the number of columns of a matrix to be used as the data patch, from among the plurality of blocks, and stores the selected blocks in the respective line memories, and the data patch generator extracts pixel data values in a number of rows of the matrix of the data patch from each of the plurality of line memories, and generates a matrix to be used as a data patch, wherein the pixel data values extracted from the same line memory are in the same row.

4. The apparatus of claim 3, wherein:

the line memory controller selects blocks that are spaced apart from each other by a uniform interval greater than one block, from among the plurality of blocks, and the data patch generator extracts a plurality of pixel data values that are spaced apart from each other by a uniform interval greater than one pixel, from among the pixel data values stored in each of the plurality of line memories.

5. The apparatus of claim 1, wherein the plurality of line memories comprises a number of line memories equal to or greater than the number of columns of a matrix to be used as the data patch.

6. The apparatus of claim 1, wherein the line memory controller determines whether there is a block already stored in the plurality of line memories from among the selected blocks, and stores remaining blocks excluding the block already stored in the plurality of line memories.

7. The apparatus of claim 1, wherein the divider, the line memory controller, and the data patch generator comprises at least one of an application-specific integrated circuit (ASIC), a substrate, or a field-programmable gate array (FPGA).

8. A method of processing image data of an apparatus for processing image data comprising a plurality of line memories, the method comprising:

dividing image data into a plurality of blocks, wherein each of the plurality of blocks corresponds to a respective row of a matrix of the image data, and has a length corresponding to a width of the image data;

storing each of the plurality of blocks into a respective one of a plurality of line memories installed in the apparatus as an internal circuit; and generating a data patch for sub-sampling of the image data by sequentially accessing pixel data values stored in each of the plurality of line memories.

9. The method of claim 8, wherein the generating of the data patch comprises:

storing the pixel data values stored in each of the plurality of line memories in a respective one of a plurality of delay registers by shifting the pixel data values by one bit for each reference clock; and extracting pixel data values located in predetermined addresses from each of the plurality of delay registers.

10. The method of claim 8, wherein:

the storing of the plurality of blocks comprises selecting a number of blocks corresponding to the number of columns in a matrix to be used as the data patch and storing each of the selected blocks in a respective one of the plurality of line memories, and the generating of the data patch comprises extracting a number of pixel data values corresponding to the number of rows in the matrix to be used as the data patch from each of the plurality of line memories and generating a data patch in a matrix form, wherein the pixel data values extracted from the same line memory are in the same row.

11. The method of claim 10, wherein:

the storing of the plurality of blocks further comprises selecting blocks that are spaced apart from each other by a uniform interval greater than one block, from among the plurality of blocks, and the generating of the data patch further comprises extracting a plurality of pixel data values that are spaced apart from each other by a uniform interval greater than one pixel, from among the pixel data values stored in each of the plurality of line memories.

12. The method of claim 8, wherein the storing of the plurality of blocks comprises:

determining whether there is a block already stored in the plurality of line memories from among the plurality of blocks, and storing the remaining blocks excluding the block already stored in the plurality of line memories.

13. A non-transitory computer-readable storage medium having stored thereon a program executable by a processor for performing a method of processing image data, the method comprising:

dividing image data into a plurality of blocks, wherein each of the plurality of blocks corresponds to a respective row of a matrix of the image data, and has a length corresponding to a width of the image data;

storing each of the plurality of blocks into a respective one of a plurality of line memories installed as an internal circuit in an apparatus comprising said processor; and generating a data patch for sub-sampling of the image data by sequentially accessing pixel data values stored in each of the plurality of line memories.

14. The computer-readable storage medium of claim 13, wherein the generating of the data patch comprises:

storing the pixel data values stored in each of the plurality of line memories in a respective one of a plurality of delay registers by shifting the pixel data values by one bit for each reference clock; and extracting pixel data values located in predetermined addresses from each of the plurality of delay registers.

15. The computer-readable storage medium of claim 13, wherein the storing of the plurality of blocks comprises:

selecting a number of blocks corresponding to the number of columns in a matrix to be used as the data patch and storing each of the selected blocks in a respective one of the plurality of line memories, and the generating of the data patch comprises extracting a number of pixel data values corresponding to the number of rows in the matrix to be used as the data patch from each of the plurality of line memories and generating a data patch in a matrix form, wherein the pixel data values extracted from the same line memory are in the same row.

16. The computer-readable storage medium of claim 15, wherein:

the storing of the plurality of blocks further comprises selecting blocks that are spaced apart from each other by a uniform interval greater than one block, from among the plurality of blocks, and the generating of the data patch further comprises extracting a plurality of pixel data values that are spaced apart from each other by a uniform interval greater than one pixel, from among the pixel data values stored in each of the plurality of line memories.

17. The computer-readable storage medium of claim 13, wherein the storing of the plurality of blocks comprises:

determining whether there is a block already stored in the plurality of line memories from among the plurality of blocks, and storing the remaining blocks excluding the block already stored in the plurality of line memories.

* * * * *